US006969251B2

(12) United States Patent
Stalder et al.

(10) Patent No.: US 6,969,251 B2
(45) Date of Patent: Nov. 29, 2005

(54) BURNER

(75) Inventors: Marcel Stalder, Klingnau (CH); Majed Toqan, Zurich (CH)

(73) Assignee: ALSTOM Technology Ltd, Baden (CH)

( * ) Notice: Subject to any disclaimer, the term of this patent is extended or adjusted under 35 U.S.C. 154(b) by 0 days.

(21) Appl. No.: 10/682,203

(22) Filed: Oct. 10, 2003

(65) Prior Publication Data

US 2004/0131986 A1 Jul. 8, 2004

(30) Foreign Application Priority Data

Oct. 12, 2002 (DE) ..... 102 47 955

(51) Int. Cl.[7] ..... F23D 14/46
(52) U.S. Cl. ..... 431/350; 60/767
(58) Field of Search ..... 431/8, 114, 285, 431/350, 353; 60/725, 761, 767

(56) References Cited

U.S. PATENT DOCUMENTS

| | | | | |
|---|---|---|---|---|
| 3,774,846 A | | 11/1973 | Schurig et al. | 239/102 |
| 3,819,319 A | * | 6/1974 | Schreter | 431/5 |
| 4,021,183 A | | 5/1977 | Gillis et al. | 431/2 |
| 4,036,581 A | | 7/1977 | Keyser et al. | 431/267 |
| 4,916,904 A | | 4/1990 | Ramsaier et al. | 60/723 |
| 4,932,861 A | | 6/1990 | Keller et al. | 431/8 |
| 5,109,669 A | | 5/1992 | Morris et al. | 60/39.821 |
| 5,735,687 A | | 4/1998 | Knöpfel et al. | 431/354 |
| 6,176,087 B1 | * | 1/2001 | Snyder et al. | 60/737 |

FOREIGN PATENT DOCUMENTS

| | | |
|---|---|---|
| DE | 35 12 948 C2 | 10/1986 |
| DE | 196 20 874 A1 | 11/1997 |
| EP | 0 321 809 B1 | 6/1989 |
| EP | 0 780 629 A2 | 6/1997 |
| WO | WO 93/17279 | 9/1993 |

OTHER PUBLICATIONS

Mitteilungen aus dem Institut für Aerodynamik an der ETH Zürich, Nr. 21, Seite 18, 1954, H. Sprenger: "Über thermische Effekte in Resonanzrohren" [On thermal effects with resonance tubes].

* cited by examiner

*Primary Examiner*—Stephen Gravini
(74) *Attorney, Agent, or Firm*—Steptoe & Johnson LLP

(57) ABSTRACT

A burner (1) for heat generation, in particular in a gas turbine, is disclosed as well as a method for the stabilization of the flame of a burner (1). The burner (1) comprises inlet openings (3) for a combustion air stream, at least a swirl generator (2) for the combustion air stream and one or more first fuel supplies (4) with first fuel outlet openings (5) for injection of fuel into the combustion air stream. At least one resonance tube (6) with an open (7) and an essentially closed end (8) is arranged in or at the burner (1), whose closed end (8) is positioned in the region of a flame front (9) which forms during operation of the burner (1) on the side of the burner (1). An outlet opening (10) of a supply (11) for a compressible medium is arranged at the open end (7) of the resonance tube (6). By injection of the compressible medium into the resonance tube (6) when flame pulsation occur, the compressible medium periodically enters and leaves the resonance tube (6) through the open end (7), by which the closed end (8) of the resonance tube (6) heats up. This heating up stabilizes the flame.

31 Claims, 3 Drawing Sheets

BURNER

FIELD OF THE INVENTION

The present invention relates to a premix burner for heat generation, in particular in a gas turbine, which comprises inlet openings for a combustion air stream, at least a swirl generator for the combustion air stream, and one or more first fuel supplies with first fuel outlet openings for injection of fuel into the combustion air stream. The invention further relates to a method for the stabilization of the flame of a premix burner. A preferred field of application of the present burner as well as of the associated method is the field of gas and steam turbine technology, in which the burner is arranged in a combustion chamber of the gas or steam turbine.

BACKGROUND OF THE INVENTION

A conical burner comprised of several jackets, a so-called double-cone burner, is known from EP 0 321 809 B1. The conical swirl generator comprised of several jackets generates a closed torque stream, which becomes unstable due to the increasing torque in the direction of the burner outlet opening, and is transformed into a ring-shaped torque stream with a reverse stream in the core. The jackets of the swirl generator are composed in such a way that tangential air inlet slots are formed for combustion air along the burner axis.

Supplies for premix gas, i.e. the gaseous fuel, are provided on the inflow angle of the cone jackets on these air intake slots, which have outlet openings for the premix gas distributed along the direction of the burner axis. The gas is jetted in through the outlet openings, or bores, respectively, lateral to the air intake slot. This jet combined with the torque of the combustion air/fuel gas stream created in the torque space leads to a good mixture of the fuel or premix gas with the combustion air. A good mixture is a prerequisite in these premix burners for low $NO_x$ values during the combustion process.

As a further improvement of such a burner, a burner for heat generation is known from EP 0 780 629 A2, which in addition to the swirl generator, has an additional mixing course for the further mixing of fuel and combustion air. This mixing course can, for example, be embodied as a down streamed tube section, into which the stream leaving the swirl generator is transferred without any significant loss of stream. The degree of mixing can be further increased, and the emission of pollutants can therefore be reduced by means of the additional mixing course.

WO 93/17279 shows another known premix burner, in which a cylindrical swirl generator with a conical interior body is used. In this burner, the premix gas is also jetted into the torque space via supplies with respective outlet openings, which are arranged along the axially extending air intake slots. In its conical interior body, the burner additionally has a central supply for pilot gas, which can be jetted into the pilot area adjacent to the burner outlet. The additional pilot level serves for the startup of the burner and an expansion of the operating range.

Such premix burners are used particularly in modern natural gas-fired gas turbines for the reduction of nitrogen emissions ($NO_x$). The burners operate at the operating point of the gas turbine, but also operate in the upper load range at part load operation at high firing temperatures. In order to maintain the $NO_x$, emissions within certain limits, which are continuously being further tightened by legislators of many countries, the premix burners must be operated at a very lean operational mode near their quenching limits. In part, however, strong pulsations occur during this operating range, which may cause damage to the burner and the combustion chamber components of the gas turbine.

In order to avoid or reduce the pulsations, so-called passive measures are known which are used to change the pulsation behavior on the burner and in the combustion chamber. To some extent, however, these measures require massive changes, adjustments, or even new developments of the burner and the combustion chamber system.

A fuel injection system for a stepped gas turbine combustion chamber is known from DE 196 20 874 A1, in which the main burner is operated with pulsated fuel injection.

By means of a targeted selection of the pulsation frequency, the common combustion frequencies can be controlled with this technology in such a way that combustion pulsations can be reduced.

The pulsated injection of fuel is also utilized in the so-called active pulsation control method. In this method, the combustion pulsations are measured by means of a pressure sensor and analyzed. In case combustion pulsations occur that are too strong, a small part of the supplied fuel quantity is fed via a separate gauge, and supplied to the burner in a pulsated manner. The pulsation frequency is adjusted according to the highest peak amplitude of the measured combustion pulsations, but phase-delayed. The total fuel stream modulated in this way causes the combustion pulsations to be attenuated, and they are not able to self-increase, or swing back up. A disadvantage of the pulsated supply of fuel, however, is that gauges are required for the modulation of the fuel supply, which must be able to generate a modulation at a frequency from a few Hz up to several hundred Hz. But such gauges are exposed to substantial wear of the movable parts, and can therefore cause a failure of the gas turbine facility.

Based on this prior art, the task of the present invention is to provide a premix burner with improved flame stabilization, as well as a method for improved stabilization of the flame of a burner, which requires fewer assembly components that are prone to wear and tear.

SUMMARY OF THE INVENTION

The task is solved with the premix burner as well as the method according to the present invention. Advantageous embodiments of the premix burner and of the method can be found in the following description and embodiment examples.

As is familiar, the present premix burner has inlet openings for a combustion air stream, at least a swirl generator for the combustion air stream, and one or several fuel supplies with first fuel outlet openings for injection of fuel into the combustion air stream. Any desired geometry of the burner and type of swirl generator can be selected, as long as the function of the premix burner is achieved by means of the selected embodiment. Examples for suitable burner geometries are listed in the printed publications on prior art named above, or in the embodiment examples.

With the present burner, at least one resonance tube with one open and one essentially closed end is arranged in or at the burner, the closed end of which is positioned in the region of a flame front which forms during the operation of the burner on the side of the burner, and on the open end of which an outlet opening of a supply for a compressible medium is arranged. The compressible medium is preferably a gaseous medium, particularly air, or a gaseous fuel of the burner. When the burner is used in a gas turbine facility, compressed air, for example, can be supplied to the compressor level as the compressible medium. In a preferred embodiment of the premix burner, as well as of the method, the supply is a fuel supply, hereinafter referred to as second fuel supply, by means of which the resonance tube is pressurized or operated with gaseous fuel as the compressible medium. This second fuel supply can be switched on and off independently of the first fuel supplies.

The resonance tube is a tube that is open on one side, and essentially closed on the other side while the term essentially closed also means an embodiment, in which the closed end has an opening with an opening cross section of up to a maximum of 10% of the opening cross section of the open end. Such a resonance tube can, for example, have a cylindrical cross section, or a cross section that is decreased from the open to the closed end. The reduction of the interior cross section may occur continuously, or at several intervals. The outlet opening for the compressible medium in the present burner is arranged relative to the open end of the resonance tube in such a way that the resonance operation of the resonance tube is possible with the supplied medium. This usually requires a smaller distance from this outlet opening to the open end of the resonance tube. During this resonance operation, the compressible medium periodically enters and leaves the resonance tube through the open end.

The resonance tube is arranged at a suitable position of the burner with its closed end in the region formed by the flame front during the operation of the burner, in order to stabilize the premix flame. Preferably, the closed end of the resonance tube is arranged on the flame root, i.e. on the flame front in the region of the burner axis, or at the step from the burner to the combustion chamber, i.e. in the region of the lateral limits of the outlet openings of the burner. The arrangement in the region of the burner axis achieves an internal stabilization of the flame, while the lateral arrangement on the burner outlet enables the exterior stabilization of the flame. Of course, a combination of both stabilizations is possible when two or more resonance tubes are attached to the burner with the respective supplies. In this case, one resonance tube is preferably arranged on the burner axis; the additional ones are arranged with their closed ends in the region of the lateral limits of the burner outlet opening.

During the operation of the present burner, the supply for the compressible medium to the resonance tube is then preferably switched in, and the resonance tube is pressurized with this medium whenever stabilization of the premix flame is required due to the pulsations being too high, and damage to the combustion chamber or to the burners used is therefore expected. By switching in the compressible medium to the resonance tube, the same now periodically enters into the resonance tube and leaves it again. This resonant operational mode causes the heating up of the tube at its closed end. This heating effect was first described by H. S. Sprenger in "About Thermal Effects in Resonance Tubes," notifications from the Institute for Aerodynamics at the ETH Zurich, No. 21, page 18, 1954. By means of a suitable dimensioning of the resonance tube and of the outlet opening of the supply, temperatures of up to 1200° C. of the closed end of the resonance tube can be achieved within a few milliseconds. Among other factors, the temperature/time behavior depends on the pressure used to supply the compressible medium.

This heating up of the closed end of the resonance tube is utilized with the present burner or the present method for stabilization of the flame. The air/fuel mixture of the premix flame is additionally ignited at the hot surface of the resonance tube by means of the hot surface of the closed end, and not only at its hot re-circulating exhaust gases. This additional ignition of the premix flame therefore occurs at a fixed geometrically defined location, which positively influences the pulsation behavior.

The following description specifically refers to the use of gaseous fuel as the compressible medium, hereinafter also referred to as resonance fuel. However, this is not to be considered a limitation, as a different compressible medium can also be used in place of this resonance fuel in the same manner in most embodiments.

In one of the embodiments of the invention, a small extra amount of resonance fuel that leaves through a small opening at the resonance tube at its closed end can also be supplied to the premix flame. This additionally stabilizes the flame locally. A floating away or jumping back of the flame is effectively counteracted in this way, and the pulsations are respectively attenuated. The resonance fuel flowing back through the open end of the resonance tube also preferably is supplied through one or several supply channels of the premix flame. If this resonance fuel is supplied in the region of the hot surface of the closed end of the resonance tube, the pulsation-attenuating effects are increased.

With the present premix burner as well as with the associated method, an additional stabilization of the premix flame of the premix burner can be achieved. This additional stabilization also makes it possible to expand the operational range that is low in pulsations to lower flame temperatures, and therefore to also achieve lower $NO_x$ values. Contrary to the process principle of the active pulsation control method by means of pulsated injection of the fuel as mentioned in the introduction, the present method requires no modulation of the fuel stream by means of any movable parts. Rather, a simple open/close gauge suffices for the pressurization of the resonance tube, which is used to switch the supply of the resonance fuel on and off over a respectively long period of time as compared to the modulation mentioned above. The wear of such an open/close gauge is therefore substantially lower in this operational mode, than with the gauges of the active pulsation control method that are required for rapid modulation. With the jetting of the resonance fuel that flows back from the resonance tube into the premix flame, a modulation of the fuel amount of this resonance fuel is achieved by means of the resonance effect in the resonance tube without the use of any movable parts.

The outlet opening for the supply of the resonance fuel to the resonance tube preferably is embodied as a nozzle. The use of a venturi nozzle is of particular benefit for this purpose. However, other nozzle types also may be used. The resonance fuel is supplied to the nozzle preferably in compressed form so that a supercritical stream can occur from the nozzle. High temperatures can be achieved in this operational mode in a short amount of time. The pressurization of the resonance fuel preferably occurs by means of a compressor in the second fuel supply, which additionally pressurizes the gaseous fuel supplied from the mutual fuel line with or without the first fuel supplies. Of course, the resonance fuel also can be branched off from one of the first fuel supplies, whereby the compressor must then be arranged behind the branch connection.

With the operation of the present premix burner, it is beneficial if the pressure of the resonance fuel has a constant pressure reading before leaving the outlet opening. This constant pressure is achieved preferably by means of a pressure reservoir in the second fuel supply in front of the open/close gauge in combination with a pressure holding gauge between the pressure reservoir and the outlet opening.

The pressure reservoir is filled by means of the compressor during idle mode, or if necessary during the operation of the burner or of a gas turbine facility, respectively, in which the burner is preferably used. The pressure in front of the resonance tube is maintained at a constant value by means of the pressure holding gauge, which achieves an optimum resonance and stabilizing effect.

If different combustion chamber pressures are anticipated during the operation of the premix burner for which the premix flame must be stabilized, it may be beneficial to use a control gauge instead of a pressure holding gauge in order to control a certain pressure ratio between the pressure of the resonance fuel and the pressure in the combustion chamber, instead of a constant pressure level.

If a control gauge is used in the second fuel supply, the resonance tube can also be utilized as an igniter for the premix burner. The mass flow rate of the resonance fuel required for the ignition, as well as the pressure of this resonance fuel, are adjusted by means of the control gauge. The resonance tube is heated up to the ignition temperature at its closed end so that the premix burner requires no separate ignition device.

In an advantageous embodiment of the present premix burner, in which the same has a central burner lance for the supply of pilot fuel, or an interior body which may also contain a supply for pilot fuel, the resonance tube is integrated into this burner lance, or interior body, respectively. In this embodiment, part of the resonance fuel leaving the open end of the resonance tube also can be jetted into the premix flame via the supply channels for the pilot fuel in order to additionally stabilize the same. Of course, additional resonance tubes can be arranged in this region or at the exterior limit of the burner outlet opening with its closed end both with this embodiment and with other embodiments of the premix burner, in which at least one resonance tube is arranged at or in the region of the central axis of the burner. If several of these additional resonance tubes are arranged at the exterior limit of the burner outlet opening, an even distribution across the circumference of the burner outlet opening would be beneficial.

BRIEF DESCRIPTION OF THE DRAWINGS

The present invention again briefly is explained as follows by means of the embodiment examples combined with the drawings, wherein.

DETAILED DESCRIPTION OF THE PREFERRED EMBODIMENTS

Figure 1:
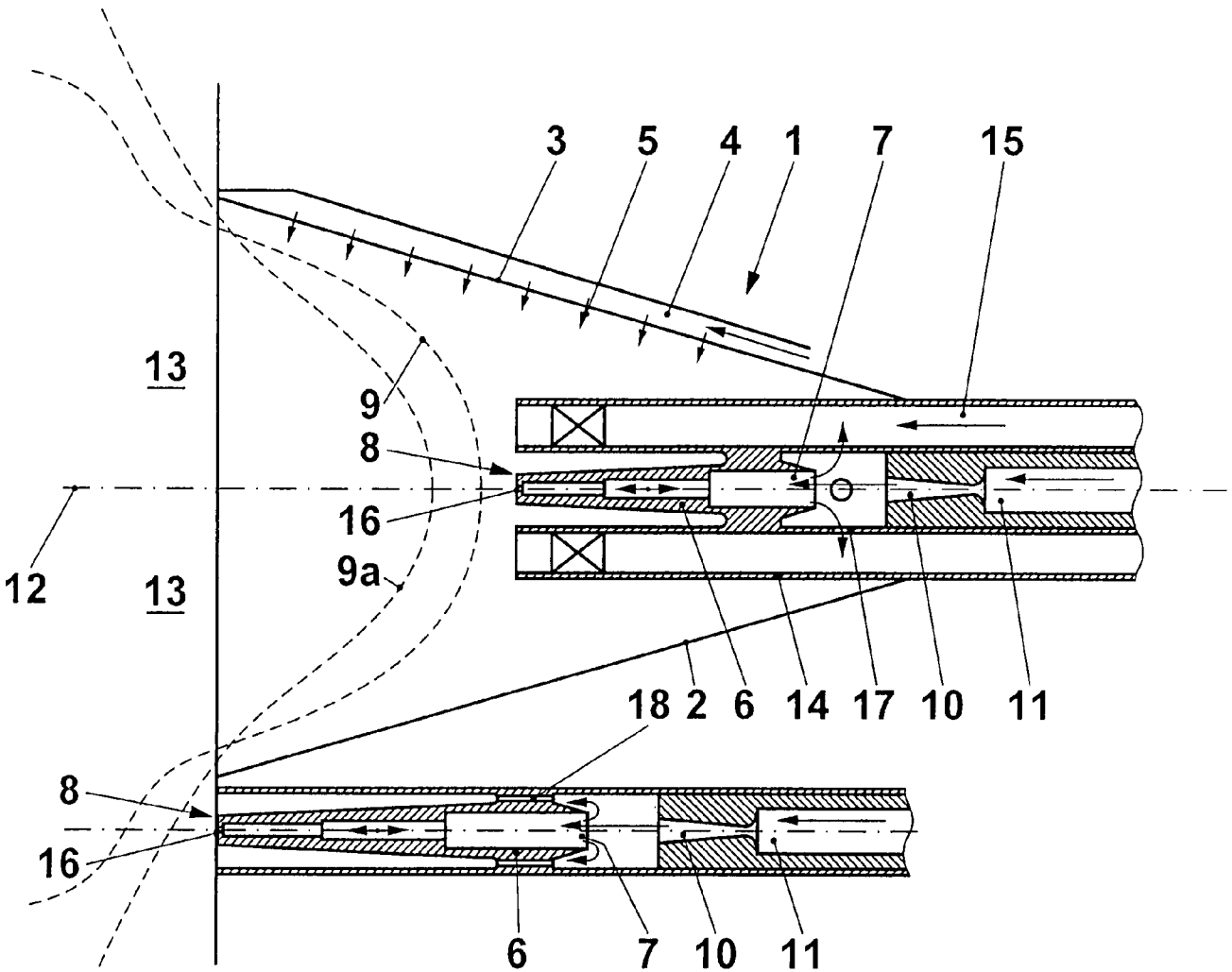
FIG. 1 shows a cross-sectional side view of an exemplary embodiment of a premix burner according to the present invention.

FIG. 1 shows an example in a cross-section, of a possible embodiment of a premix burner according to the present invention for use in a gas turbine. This premix burner 1 is comprised of two interlocking partial cone jackets as the swirl generator 2, which form two opposite positioned longitudinal slots 3 for the intake of combustion air into the interior of burner 1. The first fuel supplies 4 for the premix gas, which have several first fuel outlet openings 5 for the injection of the premix fuel into the combustion air stream, extend along these inlet slots 3 for combustion air. These fuel outlet openings 5 are indicated in the figure by means of arrows. The present burner 1 further has a central burner lance 14 with a ring-shaped supply channel 15 for pilot fuel. This pilot fuel is activated only with the startup of the gas turbine, as is known from prior art. This pilot level is turned off under load.

A resonance tube 6 is arranged within the burner lance 14 on the burner axis 12, the closed end 8 of which is directed toward the burner outlet into the combustion chamber 13. The position of this closed end 8 is located within the region of a flame front 9 of the generated premix flame that is formed during the premix operation of this burner on the side of the burner 1. The figure indicates the course of the flame front 9 of a flame stabilized by means of the use of the resonance tube 6 as compared to the flame front 9*a* of an unstable flame.

An outlet opening 10 in the form of a nozzle of a second fuel supply 11 is arranged at the open end 7 of the resonance tube 6, through which the resonance fuel is supplied. In the same way, an additional resonance tube 6 is arranged at one side of the burner 1 in such a way that the closed end 8 is positioned in the region of the lateral limit of the burner outlet opening. Resonance fuel also is supplied to this exterior resonance tube 6 through a second fuel supply 11 and a second fuel outlet opening 10 that is embodied as a nozzle, through the open end 7. With both resonance tubes 6, a distance is maintained between the outlet opening 10 of the nozzle and the open end 7 of the resonance tube 6, which is required for the function of the resonance tube 6. The resonance tube positioned on the burner axis 12 hereby serves for interior flame stabilization, as well as for the ignition of the premix flame; the exterior resonance tube 6 serves for the exterior flame stabilization.

During the operation of this premix burner, the supply of resonance fuel is started by the second fuel supplies 11 when pulsations of a predetermined strength occur. This is achieved by opening an open/close gauge, which is not illustrated in this figure, in the respective second fuel supply 11. The resonance fuel then flows into the resonance tube 6 through the nozzle 10 at a certain pressure. By means of the embodiment of the resonance tube 6 with the interior cross-section that decreases at intervals as shown in this example, the result is a periodic entering and leaving of the supplied resonance fuel through the open end 7. The operation of the resonance tube 6 heats up the surface of the resonance tube at the closed end 8 and activates an additional ignition of the fuel/air mixture on this surface. This additional ignition causes the stabilization of the flame front 9 of the premix burner, and therefore leads to the reduction of pulsations. For this stabilization the closed end 8 of the resonance tube 6 is heated to temperatures exceeding 600° C. For this purpose, the resonance fuel is supplied under pressure measuring up to 60 bar ($60*10^5$ Pa).

In the present example a small part of the resonance fuel injected into the resonance tube 6 additionally escapes through a small opening 16 at its closed end. Furthermore, the resonance fuel escaping from the resonance tube 6 through the open end 7 is re-supplied to the flame in the region of the hot surface of the closed end 8 of the resonance tube 6 through respective access openings 17 or 18. This occurs in the centrally arranged resonance tube 6 through the supply channel 15 for the pilot gas. In the case of the exterior resonance tube 6, this supply occurs through a channel that is embodied on the side of the resonance tube 6, as is shown in the figure. This supply of resonance fuel to the flame, which occurs in pulsations due to the operational mode of the resonance tube 6, in the region of the stabilization points predetermined by the closed end 8, leads to an additional attenuation of flame pulsations.

Even though, as shown in the present example, a resonance tube 6 is illustrated with a stepped increase of the interior cross section and a small outlet opening 16 at the closed end 8, it is not to be understood as a limitation of the embodiment of a resonance tube, but rather resonance tubes of other geometric shapes may also be used, which may not have an opening at the closed end 8, or which may have a cylindrical interior volume.

Figure 2:
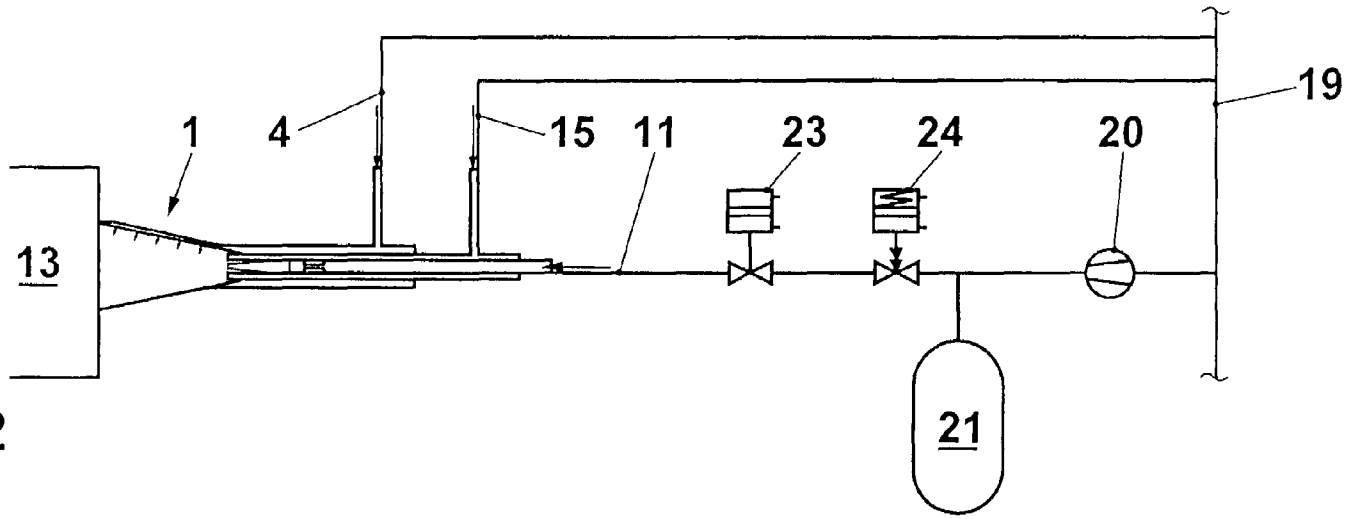
FIG. 2 shows an example of the supply of resonance fuel to the premix burner.

FIG. 2 shows a first example of an embodiment of the supply of the resonance gas to the premix burner 1. The figure shows the combustion chamber 13 and the premix burner 1, which may be embodied, for example, as shown in FIG. 1. The figure further shows the fuel supply lines leading away from a gas pipeline 19, the first fuel supply 4 for the premix gas, the supply 15 for the pilot gas, and the second fuel supply 11 for the resonance gas. These fuels are identical in the present example. A compressor 20 is provided for the resonance gas in the second fuel supply 11, which compresses the said resonance gas to the pressure range required for the operation of the resonance tube. In order to maintain a certain pressure ratio between the resonance gas that is being supplied to the resonance tube, and the pressure in the combustion chamber 13 that may vary, a pressure reservoir 21 is provided at the second fuel supply 11, which in combination with a control gauge 23 serves for maintaining a constant pressure ratio. Reference sign 24 identifies a simple open/close gauge used to switch the fuel supply on or off.

Figure 3:
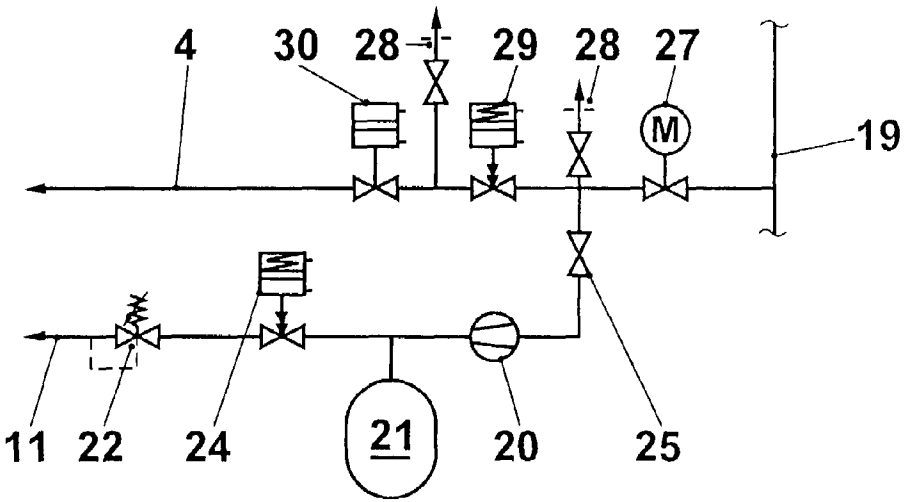
FIG. 3 shows a further example of the supply of resonance fuel to the premix burner.

FIG. 3 shows another example of the supply of resonance gas to the present premix burner. In this example, the resonance gas is branched off from the first fuel supply 4 for the premix gas by means of a bypass gauge 25. A compressor 20, a pressure reservoir 21, as well as the open/close gauge 24 in turn are indicated at the second fuel supply 11. In this example, a pressure holding gauge 22 used to maintain the pressure of the resonance gas existing at the outlet opening constant is located between the pressure reservoir 21 and the outlet opening for the resonance gas, which is not illustrated. Such an operational mode is indicated for facilities, in which the pressure in the combustion chamber does not vary substantially. As a matter of principle, a higher combustion chamber pressure must always be used with an operation under load, or with premix operation, than with a part load operation so that a higher pressure rate of the resonance gas required for the same mass flow rate must always be selected.

Of course, the compressor 20 and the pressure reservoir 21 can be omitted, if the gas pressure available in the gas pipeline is sufficiently high (60 hPa and higher in the present example).

Figure 4:
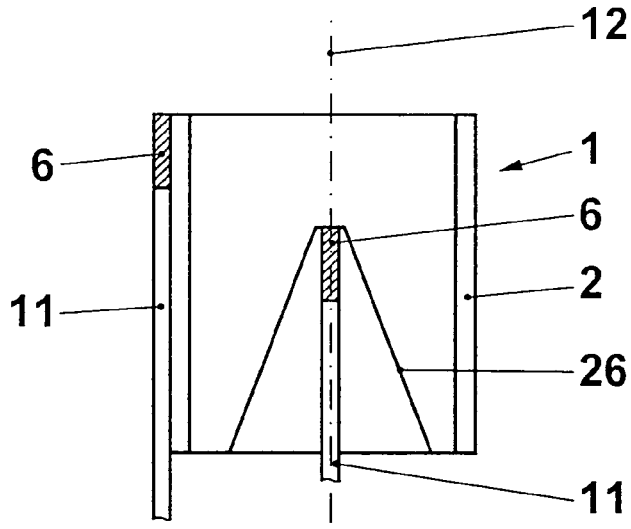
FIG. 4 shows a diagrammatic example of an additional geometric embodiment of the present premix burner.
Figure 5:
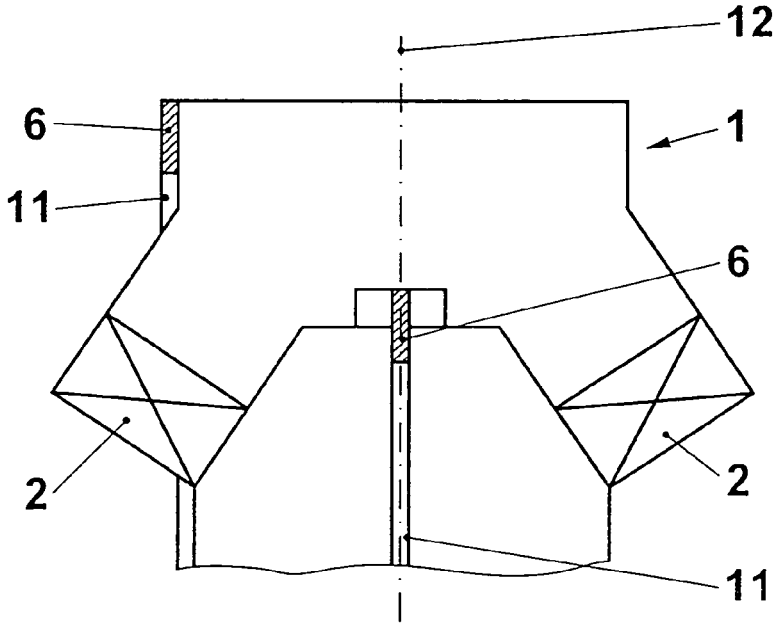
FIG. 5 shows another diagrammatic example of the geometric embodiment of a premix burner according to the present invention.

FIGS. 4 and 5 show exemplary diagrammatic examples of additional geometrical embodiments of the premix burner 1 of the present invention. These exemplary embodiments show burners whose swirl generators have different geometries. For example, FIG. 4 shows a cylindrical swirl generator 2 with a conical displacement body 26. In this example, the resonance tube 6 with the second burner supply 11 can be integrated on the central burner axis 12 in the displacement body 26, or arranged laterally on the swirl generator 2, as the figure schematically indicates.

FIG. 5 shows an additional exemplary embodiment, in which the swirl generators 2 can be embodied by means of stream baffles that are arranged in respective supplies for combustion air. With such a premix burner geometry, the resonance tubes 6 also may be embodied both in the region of the burner axis 12 and laterally at the burner outlet.

What is claimed is:

1. Burner for heat generation in particular in a gas turbine, comprising:

inlet openings for a combustion air stream, at least a swirl generator for the combustion air stream, and one or more first fuel supplies with first fuel outlet openings for injection of fuel into the combustion air stream; and at least one resonance tube with one open end and one essentially closed end arranged in or at the burner, the closed end being positioned in a region of a flame front which forms during operation of the burner on a side of the burner, the open end disposed proximate an outlet opening of a supply for a compressible medium;

wherein the supply for the compressible medium is configured to deliver the compressible medium to within the resonance tube.

2. The burner of claim 1, wherein the closed end of the resonance tube is arranged on, or at least within, a region of a central burner axis.

3. The burner of claim 1, wherein the closed end of the resonance tube is arranged within a region defined by lateral limitations of an outlet opening of the burner.

4. The burner of claim 1, wherein several resonance tubes are provided.

5. The burner of claim 4, wherein at least one of the resonance tubes is arranged with the closed end thereof on, or at least within, a region of a central burner axis, and the additional resonance tubes are arranged with closed ends thereof within a region defined by lateral limitations of an outlet opening of the burner.

6. The burner of claim 1, wherein at least one said resonance tube is integrated in a central burner lance for the supply of pilot fuel, or in a central displacement body.

7. The burner of claim 1, wherein the at least one resonance tube is arranged parallel to the burner axis.

8. The burner of claim 1, wherein the at least one resonance tube is arranged cone-shaped, or conical about the burner axis.

9. The burner of claim 1, wherein the at least one resonance tube has a constant interior diameter.

10. The burner of claim 1, wherein an interior diameter of the at least one resonance tube decreases from the open end toward the closed end.

11. The burner of claim 10, wherein the interior diameter decreases in intervals.

12. The burner of claim 1, wherein the outlet opening forms a nozzle.

13. The burner of claim 12, wherein a compressor is arranged in the supply for the compressible medium for compression in order to enable injection of the compressible medium through the nozzle into the resonance tube at a supercritical state.

14. The burner of claim 1, wherein the supply is a supply for compressed air.

15. Burner for heat generation in particular in a gas turbine, comprising:

inlet openings for a combustion air stream, at least a swirl generation for the combustion air stream, and one or more first fuel supplies with first fuel outlet openings for injection of fuel into the combustion air stream; and at least one resonance tube with one open end one essentially closed end arranged in or at the burner, the closed end being positioned in a region of a flame front which forms during operation of the burner on a side of the burner, the open end disposed proximate an outlet opening of a supply for a compressible medium;

wherein the supply is a second fuel supply switchable on and off independently of the first fuel supplies for the pressurization of the at least one resonance tube with gaseous fuel as the compressible medium.

16. The burner of claim 15, wherein the at least one resonance tube has an opening at the closed end through which a small portion of the fuel injected into the resonance tube can leave.

17. The burner of claim 16, wherein the resonance tube is disposed on a central burner axis, with the open end of the resonance tube being connected to at least one supply channel through which fuel leaving the open end is injectable into the flame.

18. The burner of claim 17, wherein the at least one supply channel is a supply for pilot fuel.

19. The burner of claim 1, further comprising a pressure holding reservoir and a pressure holding gauge arranged in the supply and used to maintain pressure of the compressible medium nearly constant in front of the at least one resonance tube.

20. The burner of claim 1, further comprising a pressure holding reservoir and a control gauge arranged in the supply and used to maintain a nearly constant pressure ratio of the compressible medium pressure in front of the at least one resonance tube to pressure in a connected combustion chamber, or to control the same.

21. Method for the operation of a burner for improved stabilization of a flame, in which the flame is stabilized by an at least one resonance tube with an open end and an essentially closed end, with the closed end being arranged in a region of a flame front forming on a side of the burner, and being pressurized by means of a compressible medium from the open end at least during the occurrence of flame pulsations continuously such that the compressible medium periodically enters and leaves the at least one resonance tube through the open end, wherein the closed end of the resonance tube is heated.

22. The method of claim 21, wherein the at least one resonance tube also is used for igniting the burner, the at least one resonance tube being pressurized with the compressible medium from the open end such that the closed end is heated to an ignition temperature.

23. The method of claim 21, wherein the at least one resonance tube is pressurized with air as the compressible medium.

24. The method of claim 21, wherein the at least one resonance tube is pressurized with gaseous fuel as the compressible medium.

25. The method of claim 24, wherein fuel leaving again from the open end of the at least one resonance tube is injected into the flame proximate the closed end of the at least one resonance tube.

26. The method of claim 24, wherein a small portion of fuel injected into the at least one resonance tube is injected into the flame through an opening at the closed end.

27. The method of claim 21, wherein the compressible medium is injected into the at least one resonance tube, through a nozzle, in a supercritical state.

28. The method of claim 21, wherein the compressible medium is additionally pressurized before injection into the at least one resonance tube.

29. The method of claim 21, wherein pressure of the compressible medium fed to the at least one resonance tube is maintained constant by means of a pressure reservoir and a pressure holding gauge in a supply.

30. The method of claim 21, wherein a ratio of pressure of compressible medium fed to the at least one resonance tube to pressure in a combustion chamber associated therewith is maintained constant by means of a pressure reservoir and a control gauge in a supply.

31. Burner for heat generation in particular in a gas turbine, comprising:

inlet openings for a combustion air stream, at least a swirl generator for the combustion air stream, and at least one fuel supply for injection of fuel into the combustion air stream; and at least one resonance tube with one open end and one essentially closed end, the closed end being disposed proximate a region for a flame front that forms during operation of the burner, and the open end being disposed in communication with an outlet opening of a supply for a compressible medium.

* * * * *

UNITED STATES PATENT AND TRADEMARK OFFICE

CERTIFICATE OF CORRECTION

PATENT NO. : 6,969,251 B2
DATED : November 29, 2005
INVENTOR(S) : Stalder et al.

It is certified that error appears in the above-identified patent and that said Letters Patent is hereby corrected as shown below:

Column 8,
Line 65, replace “generation” with -- generator --;

Column 9,
Line 1, after “end” insert -- and --.

Signed and Sealed this

Thirty-first Day of January, 2006

JON W. DUDAS
*Director of the United States Patent and Trademark Office*